US006450614B1

(12) United States Patent
Scheffelin et al.

(10) Patent No.: US 6,450,614 B1
(45) Date of Patent: Sep. 17, 2002

(54) PRINTHEAD DIE ALIGNMENT FOR WIDE-ARRAY INKJET PRINTHEAD ASSEMBLY

(75) Inventors: Joseph E. Scheffelin, Poway, CA (US); Melissa D. Boyd, Corvallis; James W. Ring, Blodgett, both of OR (US); Mohammad Akhavain, Escondido; Janis Horvath, San Diego, both of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/648,566

(22) Filed: Aug. 25, 2000

Related U.S. Application Data

(63) Continuation-in-part of application No. 09/216,606, filed on Dec. 17, 1998.

(51) Int. Cl.[7] ..... B41J 2/155
(52) U.S. Cl. ..... 347/42; 347/13
(58) Field of Search ..... 347/42, 13, 12, 347/15, 40, 43, 50, 59, 63, 47

(56) References Cited

U.S. PATENT DOCUMENTS

| | | | | |
|---|---|---|---|---|
| 5,016,023 A | | 5/1991 | Chan et al. | 346/1.1 |
| 5,057,854 A | | 10/1991 | Pond et al. | 346/140 R |
| 5,079,189 A | | 1/1992 | Drake et al. | 437/209 |
| 5,098,503 A | | 3/1992 | Drake | 156/299 |
| 5,160,945 A | | 11/1992 | Drake | 346/140 R |
| 5,257,043 A | * | 10/1993 | Kneezel | 347/42 |
| 5,469,199 A | * | 11/1995 | Allen et al. | 347/42 |
| 5,600,354 A | | 2/1997 | Hackleman, et al. | 347/50 |
| 5,620,614 A | * | 4/1997 | Drake et al. | 347/42 |
| 5,696,544 A | | 12/1997 | Komuro | 347/50 |
| 5,719,605 A | | 2/1998 | Anderson et al. | 347/59 |
| 5,742,305 A | | 4/1998 | Hackleman | 347/42 |
| 5,755,024 A | | 5/1998 | Drake et al. | 29/611 |
| 5,896,147 A | * | 4/1999 | Mori et al. | 347/61 |
| 5,946,012 A | | 8/1999 | Courian et al. | 347/63 |
| 6,053,598 A | | 4/2000 | Inpyn | 347/49 |
| 6,088,367 A | | 5/2000 | Fabbri | 347/49 |
| 6,254,218 B1 | * | 7/2001 | Suzuki et al. | 347/42 |

FOREIGN PATENT DOCUMENTS

| | | | |
|---|---|---|---|
| DE | 19743804 A1 | 4/1999 | B41J/2/005 |
| EP | 0666174 A2 | 8/1995 | B41J/2/14 |
| EP | 0771656 A2 | 5/1997 | B41J/2/14 |
| EP | 0914950 A2 | 5/1999 | B41J/2/155 |

OTHER PUBLICATIONS

Allen, R., "Ink Jet Printing with Large Pagewide Arrays: Issues and Challenges", Recent Progress in Ink Jet Technologies II, pp. 114–120.

* cited by examiner

*Primary Examiner*—Lamson D. Nguyen

(57) ABSTRACT

An inkjet printhead assembly includes a carrier and a plurality of printhead dies each mounted on the carrier. Each of the printhead dies has a nozzle region including a nominal nozzle region and an alignment nozzle region disposed laterally of the nominal nozzle region such that the nozzle region and, more specifically, the nominal and alignment nozzle regions facilitate alignment between the printhead dies.

34 Claims, 5 Drawing Sheets

PRINTHEAD DIE ALIGNMENT FOR WIDE-ARRAY INKJET PRINTHEAD ASSEMBLY

CROSS-REFERENCE TO RELATED APPLICATIONS

This application is a Continuation-in-Part of U.S. patent application Ser. No. 09/216,606, entitled "Multilayered Ceramic Substrate Serving as Ink Manifold and Electrical Interconnection Platform for Multiple Printhead Dies" filed on Dec. 17, 1998, assigned to the assignee of the present invention, and incorporated herein by reference. This application is related to U.S. Pat. Application, entitled "Carrier Positioning for Wide-Array Inkjet Printhead Assembly" filed on even date herewith, assigned to the assignee of the present invention, and incorporated herein by reference.

THE FIELD OF THE INVENTION

The present invention relates generally to inkjet printheads, and more particularly to a wide-array inkjet printhead assembly.

BACKGROUND OF THE INVENTION

A conventional inkjet printing system includes a printhead and an ink supply which supplies liquid ink to the printhead. The printhead ejects ink drops through a plurality of orifices or nozzles and toward a print medium, such as a sheet of paper, so as to print onto the print medium. Typically, the orifices are arranged along one or more axes such that properly sequenced ejection of ink from the orifices causes characters or other images to be printed upon the print medium as the printhead and the print medium are moved relative to each other.

In one arrangement, commonly referred to as a wide-array inkjet printing system, a plurality of individual printheads, also referred to as printhead dies, are mounted on a single carrier. As such, a number of nozzles and, therefore, an overall number of ink drops which can be ejected per second is increased. Since the overall number of drops which can be ejected per second is increased, printing speed can be increased with the wide-array inkjet printing system.

Mounting a plurality of printhead dies on a single carrier, however, requires proper alignment between the printhead dies. Misalignment between the printhead dies can adversely affect performance of the inkjet printing system. Misalignment between the printhead dies along an axis along which the nozzles are arranged, for example, leads to printing swath gaps which must be covered by multi-pass printing techniques. Unfortunately, multi-pass printing leads to slower throughput and increases the potential for printing defects such as banding. Thus, in order to create a continuous printing swath, the plurality of printhead dies should be properly mounted and aligned relative to each other on the single carrier. In addition, mounting a plurality of printhead dies on a single carrier requires that the carrier accommodate fluidic and electrical routing to and provide support for each of the printhead dies.

Accordingly, a need exists for properly mounting and aligning a plurality of printhead dies on a single carrier of a wide-array inkjet printhead assembly such that misalignment between the printhead dies and, therefore, gaps in a printing swath created by the wide-array inkjet printhead assembly are avoided while fluidic and electrical routing to and support for each of the printhead dies is maintained.

SUMMARY OF THE INVENTION

One aspect of the present invention provides an inkjet printhead assembly. The inkjet printhead assembly includes a carrier and a plurality of printhead dies each mounted on the carrier, wherein each of the printhead dies include a nominal nozzle region and an alignment nozzle region disposed laterally of the nominal nozzle region.

In one embodiment, an edge of the nominal nozzle region of a first of the printhead dies is substantially aligned with an edge of the nominal nozzle region of a second of the printhead dies. In one embodiment, an edge of the alignment nozzle region of a first of the printhead dies is substantially aligned with an edge of the alignment nozzle region of a second of the printhead dies.

In one embodiment, the alignment nozzle region of a first of the printhead dies overlaps the nominal nozzle region of a second of the printhead dies, and the alignment nozzle region of the second of the printhead dies overlaps the nominal nozzle region of the first of the printhead dies. In one embodiment, the alignment nozzle region of a first of the printhead dies is aligned laterally within the alignment nozzle region of a second of the printhead dies.

In one embodiment, each of the printhead dies include a plurality of nominal nozzles formed in the nominal nozzle region thereof and a plurality of alignment nozzles formed in the alignment nozzle region thereof.

In one embodiment, the alignment nozzle region of each of the printhead dies includes a first alignment nozzle region and a second alignment nozzle region, wherein the first and second alignment nozzle regions are disposed at opposite ends of the nominal nozzle region.

In one embodiment, each of the printhead dies includes a die end margin disposed laterally of the alignment nozzle region. In one embodiment, each of the printhead dies includes an electrical connection region disposed laterally of the die end margin.

In one embodiment, the inkjet printhead assembly also includes a second carrier and a second plurality of printhead dies each mounted on the second carrier, wherein each of the second plurality of printhead dies have a nozzle region. As such, the nozzle region of at least one of the second plurality of printhead dies overlaps the alignment nozzle region of at least one of the first named plurality of printhead dies.

Another aspect of the present invention provides a method of forming an inkjet printhead assembly. The method includes providing a carrier and mounting a plurality of printhead dies on the carrier, wherein each of the printhead dies include a nominal nozzle region and an alignment nozzle region disposed laterally of the nominal nozzle region.

Another aspect of the present invention provides an inkjet printhead module. The inkjet printhead module includes a carrier, a first printhead die mounted on the carrier, and a second printhead die mounted on the carrier and offset from the first printhead die. The first printhead die and the second printhead die both include a plurality of nominal nozzles and a plurality of alignment nozzles disposed laterally of the nominal nozzles.

Another aspect of the present invention provides a method of forming an inkjet printhead module. The method includes providing a carrier, mounting a first printhead die on the carrier, and mounting a second printhead die on the carrier and offsetting the second printhead die from the first printhead die. The first printhead die and the second printhead die both include a plurality of nominal nozzles and a plurality of alignment nozzles disposed laterally of the nominal nozzles.

In one embodiment, the present invention provides a wide-array inkjet printhead assembly which includes a plurality of printhead dies each having a plurality of nominal nozzles and a plurality of alignment nozzles which form a nominal nozzle region and an alignment nozzle region, respectively. As such, the nominal and alignment nozzle regions facilitate alignment between and sufficient overlap of the printhead dies. Thus, printing swath gaps are avoided and efficient layout of the wide-array inkjet printhead assembly is established.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. The inkjet printhead assembly and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
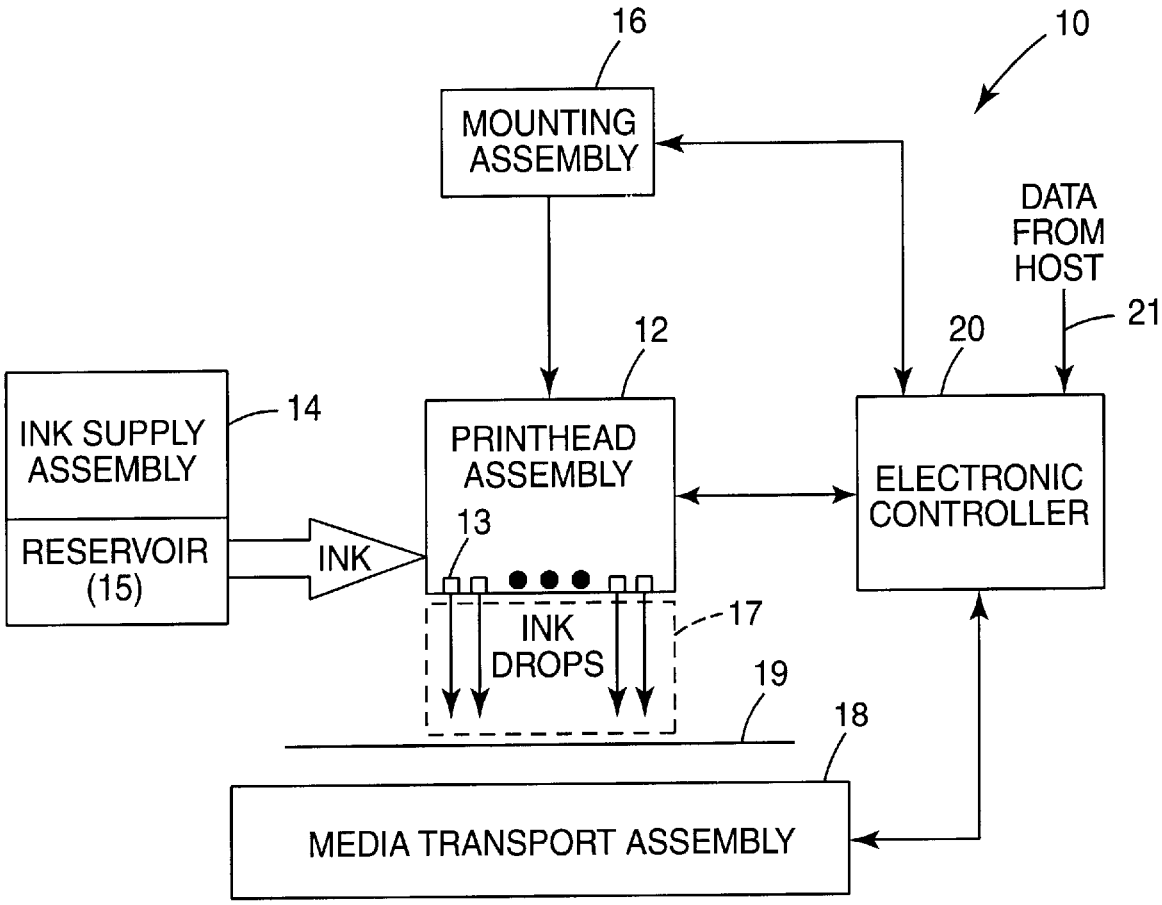
FIG. 1 is a block diagram illustrating one embodiment of an inkjet printing system according to the present invention.

FIG. 1 illustrates one embodiment of an inkjet printing system 10 according to the present invention. Inkjet printing system 10 includes an inkjet printhead assembly 12, an ink supply assembly 14, a mounting assembly 16, a media transport assembly 18, and an electronic controller 20. Inkjet printhead assembly 12 is formed according to an embodiment of the present invention, and includes one or more printheads which eject drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a re-circulating ink delivery system. In a one-way ink delivery system, substantially all of the ink supplied to inkjet printhead assembly 12 is consumed during printing. In a re-circulating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller 20 communicates with inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry is located off inkjet printhead assembly 12.

Figure 2:
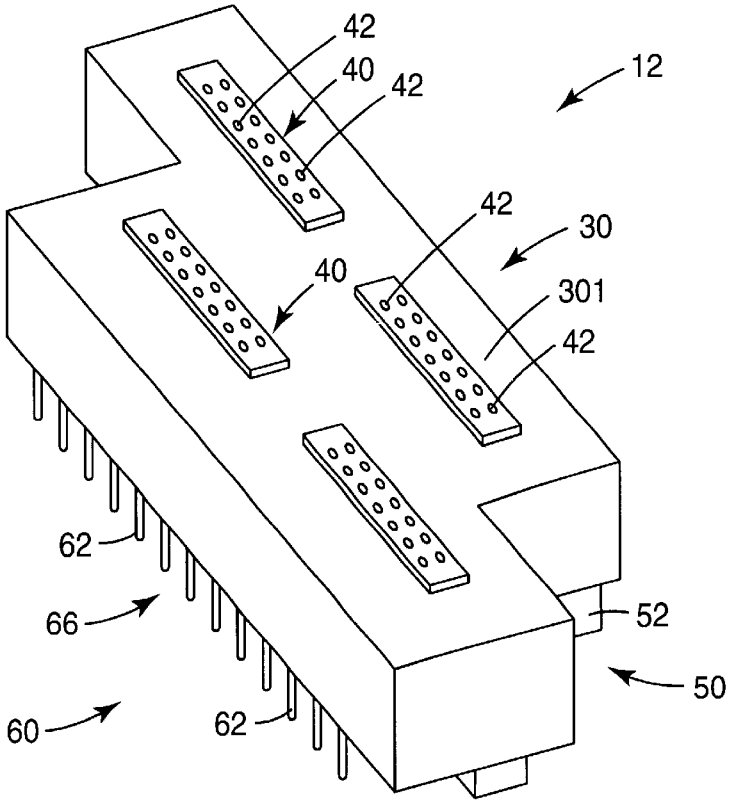
FIG. 2 is a top perspective view of an inkjet printhead assembly including a plurality of printhead dies according to the present invention.
Figure 3:
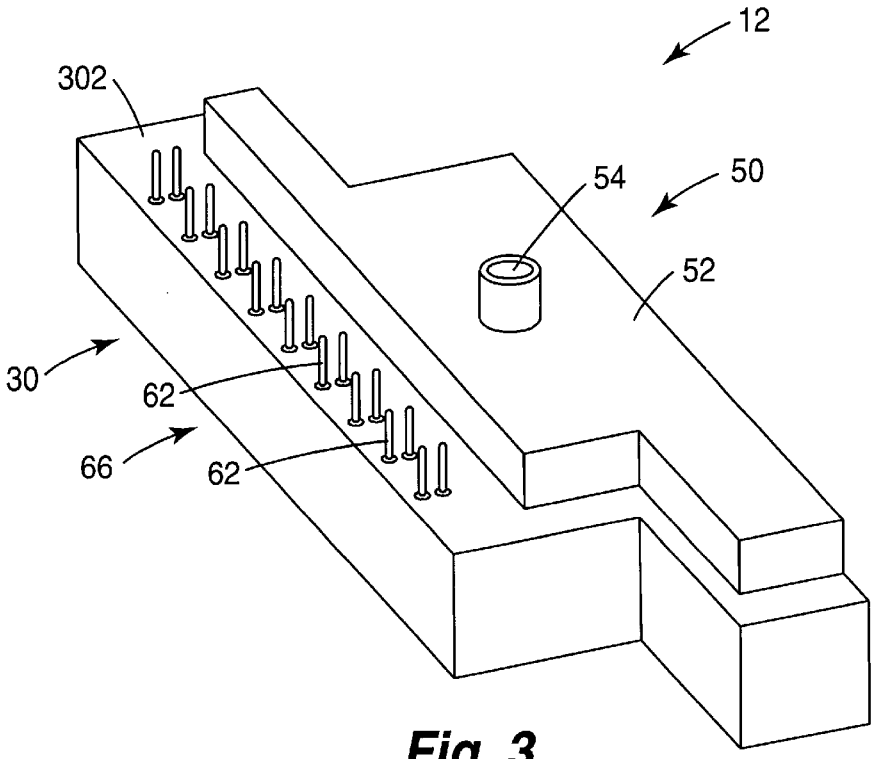
FIG. 3 is a bottom perspective view of the inkjet printhead assembly of FIG. 2.

FIGS. 2 and 3 illustrate one embodiment of a portion of inkjet printhead assembly 12. Inkjet printhead assembly 12 is a wide-array or multi-head printhead assembly and includes a carrier 30, a plurality of printhead dies 40, an ink delivery system 50, and an electronic interface system 60. Carrier 30 has an exposed surface or first face 301 and an exposed surface or second face 302 which is opposed to and oriented substantially parallel to first face 301. Carrier 30 serves to carry printhead dies 40 and provide electrical and fluidic communication between printhead dies 40, ink supply assembly 14, and electronic controller 20.

Printhead dies 40 are mounted on first face 301 of carrier 30 and aligned in one or more rows. Each printhead die 40 has a first axis 401 extending from side-to-side, as oriented in the accompanying figures, and a second axis 402. Second axis 402 extends substantially perpendicular to first axis 401 and, in one embodiment, is oriented substantially parallel with a scanning axis of inkjet printhead assembly 12.

In one embodiment, printhead dies 40 are spaced apart and staggered such that printhead dies 40 in one row overlap at least one printhead die 40 in another row, as described below. Thus, inkjet printhead assembly 12 may span a nominal page width or a width shorter or longer than nominal page width. While four printhead dies 40 are illustrated as being mounted on carrier 30, the number of printhead dies 40 mounted on carrier 30 may vary.

Ink delivery system 50 fluidically couples ink supply assembly 14 with printhead dies 40. In one embodiment, ink delivery system 50 includes a manifold 52 and a port 54. Manifold 52 is mounted on second face 302 of carrier 30 and distributes ink through carrier 30 to each printhead die 40. Port 54 communicates with manifold 52 and provides an inlet for ink supplied by ink supply assembly 14.

Electronic interface system 60 electrically couples electronic controller 20 with printhead dies 40. In one embodiment, electronic interface system 60 includes a plurality of electrical or input/output (I/O) contacts 62. I/O contacts 62 are provided on second face 302 of carrier 30 and communicate electrical signals between electronic controller 20 and printhead dies 40 through carrier 30. Examples of I/O contacts 62 include I/O pins which engage corresponding I/O receptacles electrically coupled to electric controller 20 and I/O contact pads or fingers which contact corresponding electrical nodes electrically coupled to electronic controller 20.

Figure 4:
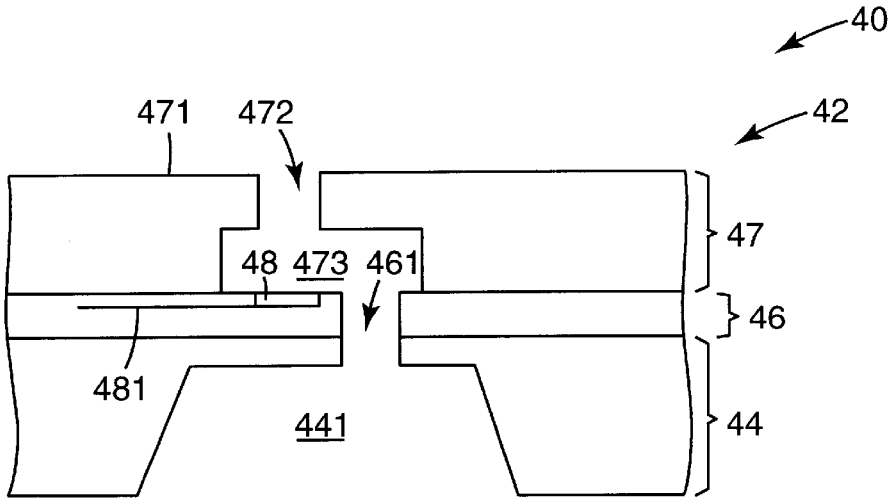
FIG. 4 is a schematic cross-sectional view illustrating portions of a printhead die according to the present invention.

As illustrated in FIGS. 2 and 4, each printhead die 40 includes an array of printing or drop ejecting elements 42. Printing elements 42, also referred to as nozzles, are formed on a substrate 44 which has an ink feed slot 441 formed therein. As such, ink feed slot 441 provides a supply of liquid ink to printing elements 42. Each printing element 42 includes a thin-film structure 46, an orifice layer 47, and a firing resistor 48. Thin-film structure 46 has an ink feed channel 461 formed therein which communicates with ink feed slot 441 of substrate 44. Orifice layer 47 has a front face 471 and a nozzle opening 472 formed in front face 471. Orifice layer 47 also has a nozzle chamber 473 formed therein which communicates with nozzle opening 472 and ink feed channel 461 of thin-film structure 46. Firing resistor 48 is positioned within nozzle chamber 473 and includes leads 481 which electrically couple firing resistor 48 to a drive signal and ground.

During printing, ink flows from ink feed slot 441 to nozzle chamber 473 via ink feed channel 461. Nozzle opening 472 is operatively associated with firing resistor 48 such that droplets of ink within nozzle chamber 473 are ejected through nozzle opening 472 (e.g., normal to the plane of firing resistor 48) and toward a print medium upon energization of firing resistor 48.

Example embodiments of printhead dies 40 include a thermal printhead, a piezoelectric printhead, a flex-tensional printhead, or any other type of inkjet ejection device known in the art. In one embodiment, printhead dies 40 are fully integrated thermal inkjet printheads. As such, substrate 44 is formed, for example, of silicon, glass, or a stable polymer and thin-film structure 46 is formed by one or more passivation or insulation layers of silicon dioxide, silicon carbide, silicon nitride, tantalum, poly-silicon glass, or other suitable material. Thin-film structure 46 also includes a conductive layer which defines firing resistor 48 and leads 481. The conductive layer is formed, for example, by aluminum, gold, tantalum, tantalum-aluminum, or other metal or metal alloy.

Figure 5:
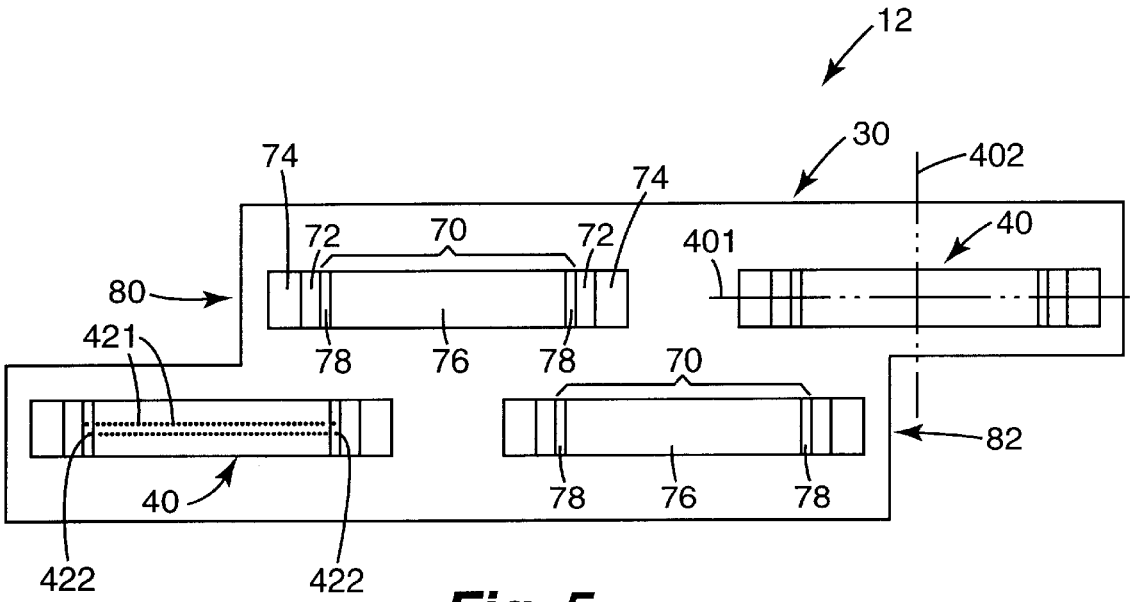
FIG. 5 is a schematic plan view of an inkjet printhead assembly according to the present invention.
Figure 6:
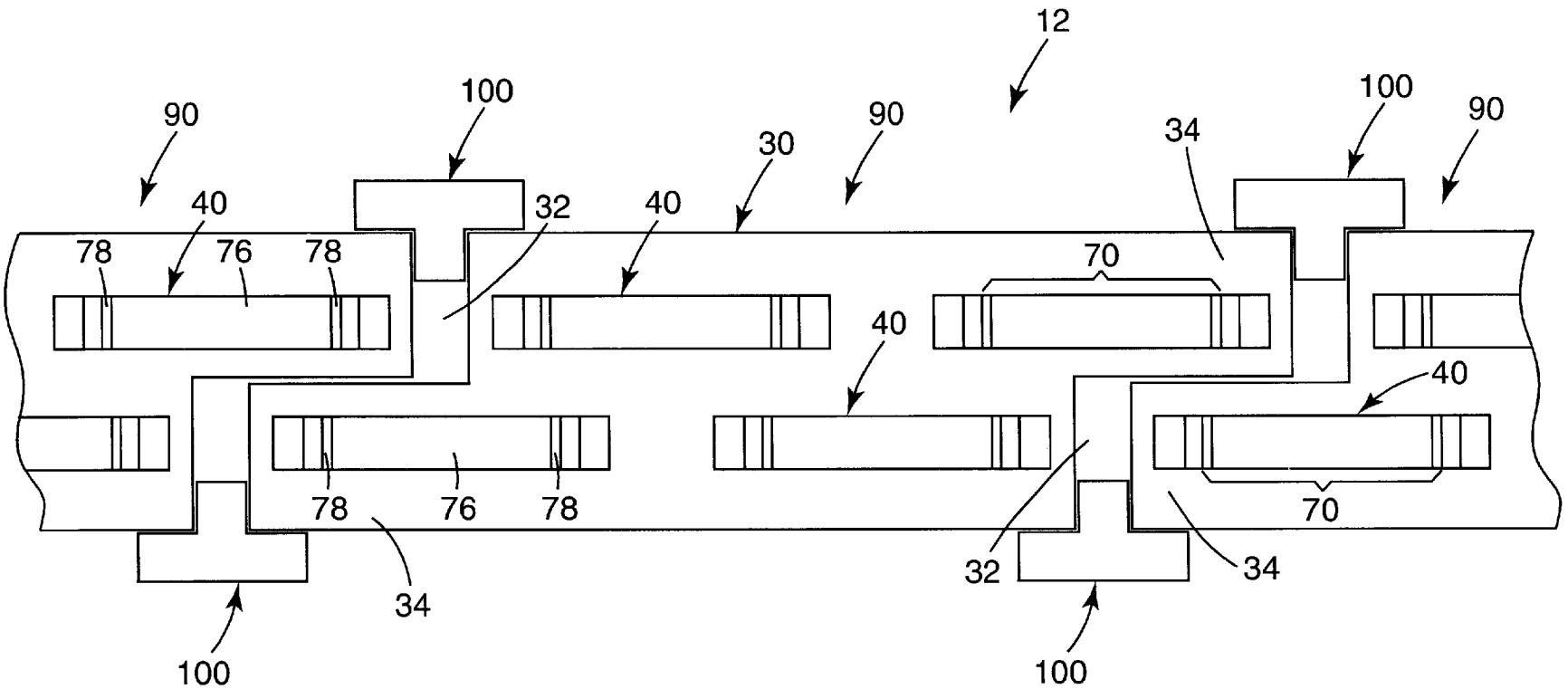
FIG. 6 is a schematic plan view of one embodiment of a plurality of inkjet printhead modules according to the present invention.

Referring to FIGS. 5 and 6, each printhead die 40 has a nozzle region 70, a die end margin 72, and an electrical connection region 74. Nozzle region 70 is centered about second axis 402 of each printhead die 40 and encompasses printing elements 42. Die end margin 72 is provided at opposite ends of nozzle region 70. Thus, die end margin 72 is adjacent to and disposed laterally of nozzle region 70. Die end margin 72 includes a portion of each printhead die 40 which extends beyond ink feed slot 441. Electrical connection region 74 is provided at opposite ends of nozzle region 70 and is adjacent to and disposed laterally of die end margin 72. Thus, electrical connection region 74 is provided at lateral edges of each printhead die 40. Electrical connection region 74 includes a portion of each printhead die 40 which accommodates electrical connection of printhead dies 40. In one embodiment, electrical connection region 74 is a wire bond region and accommodates, for example, wire bonds or leads which electrically couple electrical contacts of printhead dies 40 with electrical contacts of carrier 30.

In one embodiment, printhead dies 40 are arranged in one or more overlapping rows, as oriented in the accompanying figures. Printhead dies 40 of inkjet printhead assembly 12 are arranged, for example, in a first row 80 and a second row 82. Second row 82 is spaced from and oriented substantially parallel to first row 80. Printhead dies 40 in first row 80 are offset from printhead dies 40 in second row 82 such that each printhead die 40 in first row 80 overlaps at least one printhead die 40 in second row 82 with respect to first axis 401. More specifically, nozzle region 70 of each printhead die 40 in first row 80 overlaps nozzle region 70 of at least one printhead die 40 in second row 82. Thus, nozzles or printing elements 42 of each printhead die 40 in first row 80 overlap nozzles or printing elements 42 of at least one printhead die 40 in second row 82.

In one embodiment, nozzle region 70 includes a nominal nozzle region 76 and an alignment nozzle region 78. Nominal nozzle region 76 is centered about second axis 402 and includes a plurality of nominal nozzles or printing elements 421. Alignment nozzle region 78 is disposed at opposite ends of nominal nozzle region 76 along first axis 401. Thus, alignment nozzle region 78 is adjacent to and disposed laterally of nominal nozzle region 76. Alignment nozzle region 78 also includes a plurality of alignment nozzles or printing elements 422. It is understood that FIGS. 5 and 6 are simplified schematic illustrations of printhead dies 40 and that the number and/or arrangement of nominal nozzles 421 within nominal nozzle region 76 and/or alignment nozzles 422 within alignment nozzle region 78 are presented for clarity of the invention and may vary from that illustrated.

To ensure effective overlap between printhead dies 40 with respect to first axis 401, a lateral edge of nominal nozzle region 76 of one printhead die 40 is substantially aligned with a lateral edge of nominal nozzle region 76 of another printhead die 40. Since alignment nozzle region 78 is adjacent to and disposed laterally of nominal nozzle region 76, a laterally inner edge of alignment nozzle region 78 of one printhead die 40 is substantially aligned with a laterally inner edge of alignment nozzle region 78 of another printhead die 40. In addition, alignment nozzle region 78 of one printhead die 40 overlaps nominal nozzle region 76 of another printhead die 40. As such, alignment nozzle region 78 of one printhead die 40 is aligned laterally within alignment nozzle region 78 of another printhead die 40. Thus, nozzle region 70 of one printhead die 40 overlaps alignment nozzle region 78 of another printhead die 40.

Figure 7:
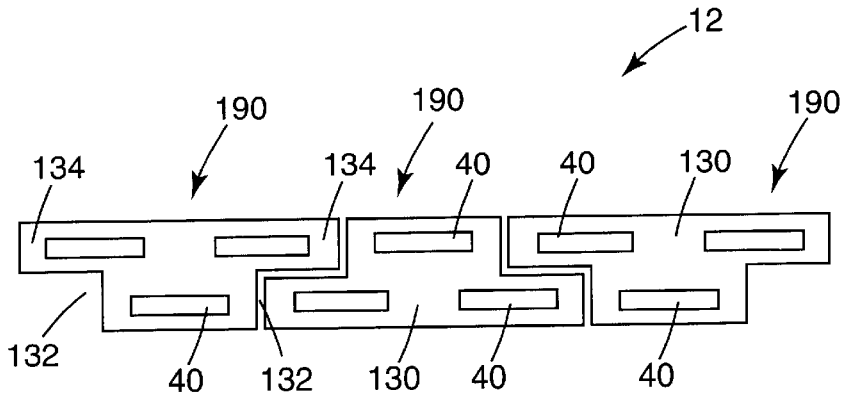
FIG. 7 is a schematic plan view of another embodiment of a plurality of inkjet printhead modules according to the present invention.
Figure 8:
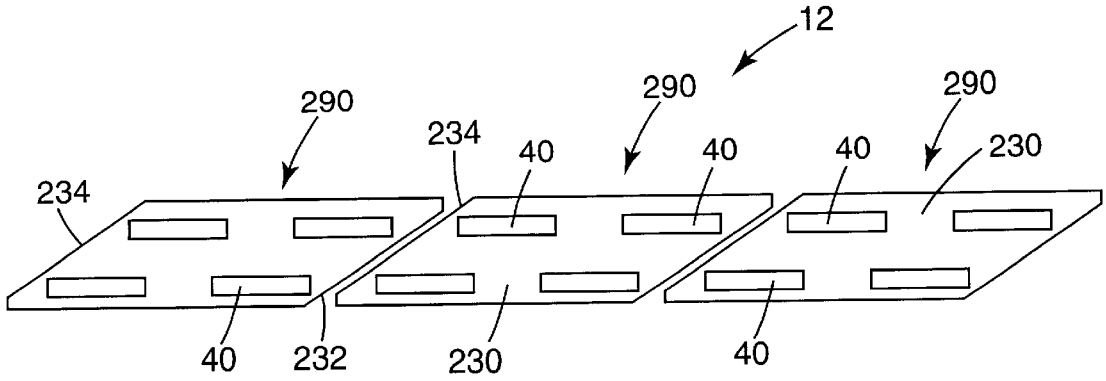
FIG. 8 is a schematic plan view of another embodiment of a plurality of inkjet printhead modules according to the present invention.
Figure 9:
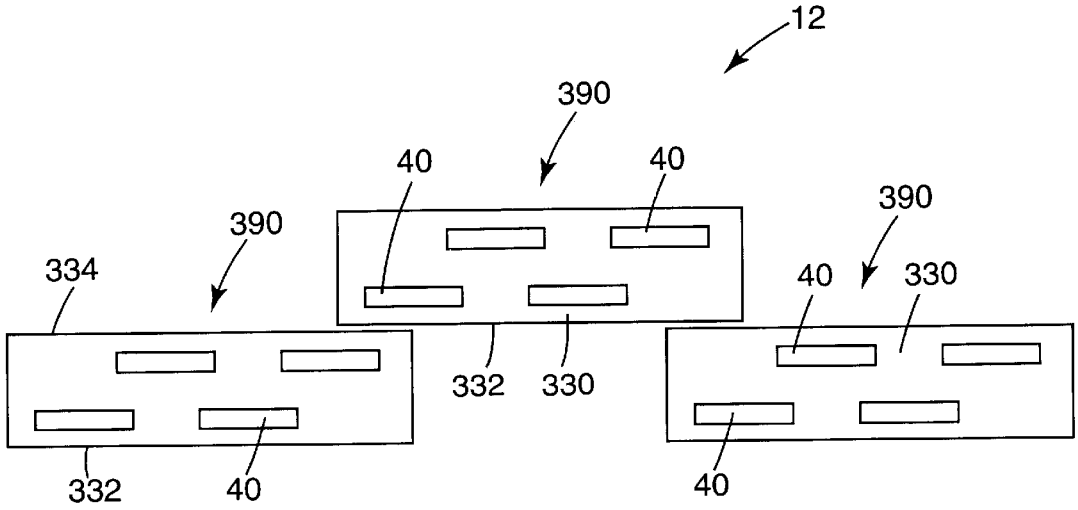
FIG. 9 is a schematic plan view of another embodiment of a plurality of inkjet printhead modules according to the present invention.

In one embodiment, as illustrated in FIGS. 6–9, inkjet printhead assembly 12 is formed of a plurality of inkjet printhead modules 90. Each inkjet printhead module 90 includes a separate carrier 30 and a plurality of printhead dies 40 mounted on carrier 30 and aligned relative to each other as described above. lnkjet printhead modules 90 are arranged such that each inkjet printhead module 90 overlaps adjacent inkjet printhead modules 90. For example, inkjet printhead modules 90 may be stacked in an end-to-end manner, as illustrated in FIGS. 6–8, or maybe staggered or offset, as illustrated in FIG. 9. Positioning of inkjet printhead assembly 12 and, more specifically, positioning of inkjet printhead modules 90 relative to each other is established by a plurality of datums 100 such as described in detail in the above-incorporated U.S. Patent Application Ser. No. 09/648,121.

Each inkjet printhead module 90 is formed so as to ensure effective overlap between printhead dies 40 of adjacent inkjet printhead modules 90. Overlap between printhead dies 40 of adjacent inkjet printhead modules 90 is similar to the overlap between printhead dies 40 mounted on one carrier 30. Thus, nozzle region 70 of one printhead die 40 of one inkjet printhead module 90 overlaps nozzle region 70 of at least one printhead die 40 of an adjacent inkjet printhead module 90. More specifically, nozzle region 70 of one printhead die 40 of one inkjet printhead module 90, for example, overlaps alignment nozzle region 78 of at least one printhead die 40 of an adjacent inkjet printhead module 90. As such, nozzles or printing elements 42 of one printhead die 40 of one inkjet printhead module 90 overlap nozzles or printing elements 42 of at least one printhead die 40 of an adjacent inkjet printhead module 90.

FIG. 6 illustrates one embodiment of inkjet printhead modules 90. Inkjet printhead modules 90 each include carrier 30 and printhead dies 40 mounted on carrier 30. Carrier 30 is generally S-shaped. To create the generally S-shape, carrier 30 is formed with rectangular end notches 32 at two diagonal corners. Thus, rectangular legs 34 are formed at two opposite diagonal corners.

Inkjet printhead modules 90 are stacked in an end-to-end manner such that rectangular notch 32 of one inkjet printhead module 90 accommodates rectangular leg 34 of an adjacent inkjet printhead module 90. Accordingly, an extended array of interleaved or overlapping inkjet printhead modules 90 is formed. As such, a compact and narrow arrangement of inkjet printhead modules 90 which preserves a width of a single carrier 30 is provided. More specifically, a continuity of overlapping rows 80 and 82 of printhead dies 40, with respect to first axis 401, is maintained between adjacent inkjet printhead modules 90. Thus, a need for over-scanning with the inkjet printhead assembly 12 to accommodate additional offset rows of printhead dies 40 is reduced. While three inkjet printhead modules 90 are illustrated as being stacked in an end-to-end manner, the number of inkjet printhead modules 90 may vary depending on a desired length of inkjet printhead assembly 12.

Inkjet printhead modules 90 include an even number of printhead dies 40 which are arranged on carrier 30 such that at least one printhead die 40 of each inkjet printhead module 90 overlaps at least one printhead die of another inkjet printhead module 90. More specifically, nozzle region 70 of one printhead die 40 of one inkjet printhead module 90 overlaps nozzle region 70 of at least one printhead die 40 of an adjacent inkjet printhead module 90 as described above.

FIG. 7 illustrates another embodiment of inkjet printhead modules 90. Inkjet printhead modules 190 each include a carrier 130 and printhead dies 40 mounted on carrier 130. Carrier 130 is generally T-shaped. To create the generally T-shape, carrier 130 is formed with rectangular end notches 132 at two opposite corners. Thus, rectangular legs 134 are formed at two opposite corners.

Inkjet printhead modules 190 are stacked in an end-to-end manner with every other inkjet printhead module 190 inverted such that rectangular notch 132 of one inkjet printhead module 190 accommodates rectangular leg 134 of an adjacent inkjet printhead module 190. Accordingly, an extended array of interleaved or overlapping inkjet printhead modules 190 is formed. As such, a compact and narrow arrangement of inkjet printhead modules 190 is provided similar to that of inkjet printhead modules 90 as described above.

Inkjet printhead modules 190 include an odd number of printhead dies 40 which are arranged on carrier 130 such that at least one printhead die 40 of each inkjet printhead module 190 overlaps at least one printhead die 40 of another inkjet printhead module 190. More specifically, nozzle region 70 of at least one printhead die 40 of one inkjet printhead module 190 overlaps nozzle region 70 of at least one printhead die 40 of an adjacent inkjet printhead module 190 in a manner similar to that of inkjet printhead modules 90 as described above.

FIG. 8 illustrates another embodiment of inkjet printhead modules 90. Inkjet printhead modules 290 each include a carrier 230 and printhead dies 40 mounted on carrier 230. Carrier 230 is of a generally parallelogram shape and has a leading edge 232 and a trailing edge 234 opposite to and parallel with leading edge 232.

Inkjet printhead modules 290 are stacked in an end-to-end manner such that leading edge 232 of one inkjet printhead module 290 follows trailing edge 234 of an adjacent inkjet printhead module 290. Accordingly, an extended array of interleaved or overlapping inkjet printhead modules 290 is formed. As such, a compact and narrow arrangement of inkjet printhead modules 290 is provided similar to that of inkjet printhead modules 90 as described above.

Inkjet printhead modules 290 include an even number of printhead dies 40 which are arranged on carrier 230 such that at least one printhead die 40 of each inkjet printhead module 290 overlaps at least one printhead die 40 of another inkjet printhead module 290. More specifically, nozzle region 70 of at least one printhead die 40 of one inkjet printhead module 290 overlaps nozzle region 70 of at least one printhead die 40 of an adjacent inkjet printhead module 290 in a manner similar to that of inkjet printhead modules 90 as described above.

FIG. 9 illustrates another embodiment of inkjet printhead modules 90. Inkjet printhead modules 390 each include a carrier 330 and printhead dies 40 mounted on carrier 330. Carrier 330 is generally rectangular shaped and has a first side 332 and a second side 334 opposite to and parallel with first side 332. As such, inkjet printhead modules 390 are stacked in a staggered manner such that a portion of first side 332 of one inkjet printhead module 390 overlaps a portion of second side 334 of an adjacent inkjet printhead module 390.

Inkjet printhead modules 390 include an even number of printhead dies 40 which are arranged on carrier 330 such that at least one printhead die 40 of each inkjet printhead module 390 overlaps at least one printhead die 40 of another inkjet printhead module 390. More specifically, nozzle region 70 of at least one printhead die 40 of one inkjet printhead module 390 overlaps nozzle region 70 of at least one printhead die 40 of an adjacent inkjet printhead module 390 in a manner similar to that of inkjet printhead modules 90 as described above.

By dividing nozzle region 70 into nominal nozzle region 76 and alignment nozzle region 78, alignment between and sufficient overlap of printhead dies 40 is facilitated. Since nominal nozzle region 76 and alignment nozzle region 78 both include a plurality of nozzles or printing elements 42, a nozzle is provided over every pixel dot row. Thus, gaps in a printing swath created by inkjet printhead assembly 12 are avoided. As such, a need for multi-pass printing is eliminated. In addition, by providing die end margin 72 and electrical connection region 74 laterally of nozzle region 70, fluidic and electrical routing to printhead dies 40, as well as an area for supporting printhead dies 40, is maintained.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An inkjet printhead assembly, comprising:

a carrier having a first side; and a plurality of printhead dies each mounted on the first side of the carrier, each of the plurality of printhead dies including a nominal nozzle region and an alignment nozzle region disposed laterally of the nominal nozzle region, wherein the alignment nozzle region of a first of the plurality of printhead dies overlaps the nominal nozzle region of a second of the plurality of printhead dies and the alignment nozzle region of the second of the plurality of printhead dies overlaps the nominal nozzle region of the first of the plurality of printhead dies.

2. The inkjet printhead assembly of claim 1, wherein an edge of the nominal nozzle region of the first of the plurality of printhead dies is substantially aligned with an edge of the nominal nozzle region of the second of the plurality of printhead dies.

3. The inkjet printhead assembly of claim 1, wherein an edge of the alignment nozzle region of the first of the plurality of printhead dies is substantially aligned with an edge of the alignment nozzle region of the second of the plurality of printhead dies.

4. The inkjet printhead assembly of claim 1, wherein the alignment nozzle region of the first of the plurality of printhead dies is aligned laterally within the alignment nozzle region of the second of the plurality of printhead dies.

5. The inkjet printhead assembly of claim 1, wherein each of the plurality of printhead dies include a plurality of nominal nozzles formed in the nominal nozzle region thereof and a plurality of alignment nozzles formed in the alignment nozzle region thereof.

6. The inkjet printhead assembly of claim 1, wherein the alignment nozzle region of each of the plurality of printhead dies includes a first alignment nozzle region and a second alignment nozzle region, the first and second alignment nozzle regions being disposed at opposite ends of the nominal nozzle region.

7. The inkjet printhead assembly of claim 1, wherein each of the plurality of printhead dies includes a die end margin disposed laterally of the alignment nozzle region.

8. The inkjet printhead assembly of claim 7, wherein each of the plurality of printhead dies includes an electrical connection region disposed laterally of the die end margin.

9. The inkjet printhead assembly of claim 1, further comprising:

a second carrier having a first side; and a second plurality of printhead dies each mounted on the first side of the second carrier, each of the second plurality of printhead dies having a nozzle region, the nozzle region of at least one of the second plurality of printhead dies overlapping the alignment nozzle region of at least one of the first named plurality of printhead dies.

10. A method of forming an inkjet printhead assembly, the method comprising:

providing a carrier having a first side; and mounting a plurality of printhead dies each including a nominal nozzle region and an alignment nozzle region disposed laterally of the nominal nozzle region on the first side of the carrier, including overlapping the nominal nozzle region of a first of the plurality of printhead dies with the alignment nozzle region of a second of the plurality of printhead dies and overlapping the nominal nozzle region of the second of the plurality of printhead dies with the alignment nozzle region of the first of the plurality of printhead dies.

11. The method of claim 10, wherein mounting the plurality of printhead dies includes aligning an edge of the nominal nozzle region of the first of the plurality of printhead dies with an edge of the nominal nozzle region of the second of the plurality of printhead dies.

12. The method of claim 10, wherein mounting the plurality of printhead dies includes aligning an edge of the alignment nozzle region of the first of the plurality of printhead dies with an edge of the alignment nozzle region of the second of the plurality of printhead dies.

13. The method of claim 10, wherein mounting the plurality of printhead dies includes aligning the alignment nozzle region of the first of the plurality of printhead dies laterally within the alignment nozzle region of the second of the plurality of printhead dies.

14. The method of claim 10, wherein each of the plurality of printhead dies include a plurality of nominal nozzles formed in the nominal nozzle region and a plurality of alignment nozzles formed in the alignment nozzle region thereof.

15. The method of claim 10, wherein the alignment nozzle region of each of the plurality of printhead dies includes a first alignment nozzle region and a second alignment nozzle region, the first and second alignment nozzle regions being disposed at opposite ends of the nominal nozzle region.

16. The method of claim 10, wherein each of the plurality of printhead dies includes a die end margin disposed laterally of the alignment nozzle region.

17. The method of claim 16, wherein each of the plurality of printhead dies includes an electrical connection region disposed laterally of the die end margin.

18. The method of claim 10, further comprising:

providing a second carrier having a first side; and mounting a second plurality of printhead dies on the first side of the second carrier, each of the second plurality of printhead dies having a nozzle region, wherein mounting the second plurality of printhead dies includes overlapping the alignment nozzle region of at least one of the first named plurality of printhead dies with the nozzle region of at least one of the second plurality of printhead dies.

19. An inkjet printhead module, comprising:

a carrier having a first side;

a first printhead die mounted on the first side of the carrier, the first printhead die including a plurality of nominal nozzles and a plurality of alignment nozzles disposed laterally of the nominal nozzles thereof; and a second printhead die mounted on the first side of the carrier and offset from the first printhead die, the second printhead die including a plurality of nominal nozzles and a plurality of alignment nozzles disposed laterally of the nominal nozzles thereof, wherein at least one of the alignment nozzles of the first printhead die overlaps at least one of the nominal nozzles of the second printhead die and at least one of the alignment nozzles of the second printhead die overlaps at least one of the nominal nozzles of the first printhead die.

20. The inkjet printhead module of claim 19, wherein the plurality of nominal nozzles of each of the first printhead die and the second printhead die define a nominal nozzle region thereof, and wherein the plurality of alignment nozzles of each of the first printhead die and the second printhead die define an alignment nozzle region thereof.

21. The inkjet printhead module of claim 20, wherein an edge of the nominal nozzle region of the first printhead die is substantially aligned with an edge of the nominal nozzle region of the second printhead die.

22. The inkjet printhead module of claim 20, wherein an edge of the alignment nozzle region of the first printhead die is substantially aligned with an edge of the alignment nozzle region of the second printhead die.

23. The inkjet printhead module of claim 20, wherein the alignment nozzle region of the first printhead die overlaps the nominal nozzle region of the second printhead die and the alignment nozzle region of the second printhead die overlaps the nominal nozzle region of the first printhead die.

24. The inkjet printhead module of claim 20, wherein the alignment nozzle region of the first printhead die is aligned laterally within the alignment nozzle region of the second printhead die.

25. The inkjet printhead module of claim 19, wherein the first printhead die and the second printhead die each include a die end margin disposed laterally of the plurality of alignment nozzles thereof.

26. The inkjet printhead module of claim 25, wherein the first printhead die and the second printhead die each include an electrical connection region disposed laterally of the die end margin thereof.

27. A method of forming an inkjet printhead module, the method comprising:

providing a carrier having a first side;

mounting a first printhead die including a plurality of nominal nozzles and a plurality of alignment nozzles disposed laterally of the nominal nozzles thereof on the first side of the carrier; and mounting a second printhead die including a plurality of nominal nozzles and a plurality of alignment nozzles disposed laterally of the nominal nozzles thereof on the first side of the carrier and offsetting the second printhead die from the first printhead die, including overlapping at least one of the nominal nozzles of the first printhead die with at least one of the alignment nozzles of the second printhead die and overlapping at least one of the nominal nozzles of the second printhead die with at least one of the alignment nozzles of the first printhead die.

28. The method of claim 27, wherein the plurality of nominal nozzles of each of the first printhead die and the second printhead die define a nominal nozzle region thereof, and wherein the plurality of alignment nozzles of each of the first printhead die and the second printhead die define an alignment nozzle region thereof.

29. The method of claim 28, wherein mounting the first printhead die and the second printhead die includes aligning an edge of the nominal nozzle region of the first printhead die with an edge of the nominal nozzle region of the second printhead die.

30. The method of claim 28, wherein mounting the first printhead die and the second printhead die includes aligning an edge of the alignment nozzle region of the first printhead die with an edge of the alignment nozzle region of the second printhead die.

31. The method of claim 28, wherein mounting the first printhead die and the second printhead die includes overlapping the nominal nozzle region of the first printhead die with the alignment nozzle region of the second printhead die and overlapping the nominal nozzle region of the second printhead die with the alignment nozzle region of the first printhead die.

32. The method of claim 28, wherein mounting the first printhead die and the second printhead die includes aligning the alignment nozzle region of the first printhead die laterally within the alignment nozzle region of the second printhead die.

33. The method of claim 27, wherein the first printhead die and the second printhead die each include a die end margin disposed laterally of the plurality of alignment nozzles thereof.

34. The method of claim 33, wherein the first printhead die and the second printhead die each include an electrical connection region disposed laterally of the die end margin thereof.

* * * * *